US008651615B2

(12) United States Patent
Elliot et al.

(10) Patent No.: US 8,651,615 B2
(45) Date of Patent: Feb. 18, 2014

(54) SYSTEM AND METHOD FOR ANALYSIS OF TEST PATTERN IMAGE DATA IN AN INKJET PRINTER USING A TEMPLATE

(75) Inventors: Michael W. Elliot, Macedon, NY (US); Charles A. Barbe, Rochester, NY (US); Thomas F. Shane, Seneca Falls, NY (US); Vivek Jaganathan, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 223 days.

(21) Appl. No.: 13/329,859

(22) Filed: Dec. 19, 2011

(65) Prior Publication Data

US 2013/0155139 A1 Jun. 20, 2013

(51) Int. Cl.
*B41J 29/393* (2006.01)
*B41J 29/38* (2006.01)
*B41J 2/05* (2006.01)

(52) U.S. Cl.
USPC ..... 347/19; 347/9; 347/14; 347/57

(58) Field of Classification Search
USPC ..... 347/9, 14, 19, 57
See application file for complete search history.

(56) References Cited

U.S. PATENT DOCUMENTS 5,461,469 A 10/1995 Ferrell et al.
5,640,200 A 6/1997 Michael
5,724,259 A 3/1998 Seymour et al.
6,163,620 A 12/2000 Hojnacki et al.
6,173,087 B1 1/2001 Kumar et al.
6,181,813 B1 1/2001 Fan et al.
6,295,374 B1 9/2001 Robinson et al.
6,504,957 B2 1/2003 Nguyen et al.
6,554,398 B2 4/2003 Wyngaert et al.
6,574,366 B1 6/2003 Fan
6,966,713 B2 11/2005 Kim
7,106,477 B2 9/2006 Horobin
7,319,778 B2 1/2008 Ono
7,333,677 B2 * 2/2008 Sakai et al. ..... 382/294
7,422,303 B2 9/2008 Kobayashi et al.
7,684,625 B2 3/2010 Hyoki
2002/0126169 A1 9/2002 Wyngaert et al.
2005/0030602 A1 2/2005 Gregson et al.
2005/0117948 A1 6/2005 Hatta et al.
2008/0019611 A1 1/2008 Larkin et al.
2008/0062219 A1 * 3/2008 Mizes et al. ..... 347/19
2009/0102873 A1 4/2009 Hayashi
2010/0119160 A1 5/2010 Sibiryakov
2010/0150406 A1 6/2010 Xiao et al.
2012/0182571 A1 * 7/2012 Wu et al. ..... 358/1.14

* cited by examiner

*Primary Examiner* — Sarah Al Hashimi
(74) *Attorney, Agent, or Firm* — Maginot, Moore & Beck, LLP

(57) ABSTRACT

Test pattern template data are stored in a memory of a printer to identify locations spatially within image data of a test pattern printed by printheads in an inkjet printer. The test pattern template data identifies an origin of a test pattern in the image data and the distances between structures in the test pattern to enable test pattern structure in the image data to be detected and identified more easily.

16 Claims, 7 Drawing Sheets

SYSTEM AND METHOD FOR ANALYSIS OF TEST PATTERN IMAGE DATA IN AN INKJET PRINTER USING A TEMPLATE

TECHNICAL FIELD

This disclosure relates generally to identification of printhead orientation in an inkjet printer having one or more printheads, and, more particularly, to analysis of image data to identify the printhead orientation.

BACKGROUND

Ink jet printers have printheads that operate a plurality of inkjets that eject liquid ink onto an image receiving member. The ink may be stored in reservoirs located within cartridges installed in the printer. Such ink may be aqueous ink or an ink emulsion. Other inkjet printers receive ink in a solid form and then melt the solid ink to generate liquid ink for ejection onto the imaging member. In these solid ink printers, the solid ink may be in the form of pellets, ink sticks, granules or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

A typical inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

In order for the printed images to correspond closely to the image data, both in terms of fidelity to the image objects and the colors represented by the image data, the printheads must be registered with reference to the imaging surface and with the other printheads in the printer. Registration of printheads is a process in which the printheads are operated to eject ink in a known pattern, typically called a test pattern, and then the printed image of the test pattern is analyzed to determine the orientation of the printhead with reference to the imaging surface and with reference to the other printheads in the printer.

Analysis of printed images is performed with reference to two directions. "Process direction" refers to the direction in which the image receiving member is moving as the imaging surface passes the printhead to receive the ejected ink and "cross-process direction" refers to the direction across the width of the image receiving member. In order to analyze a printed image, a test pattern needs to be generated so determinations can be made as to whether the inkjets operated to eject ink did, in fact, eject ink and whether the ejected ink landed where the ink would have landed if the printhead was oriented correctly with reference to the image receiving member and the other printheads in the printer.

In some printers, a scanner is integrated into the printer and positioned at a location in the printer that enables an image of an ink image to be generated while the image is on media within the printer or while the ink image is on the rotating image member. These integrated scanners typically include one or more illumination sources and a plurality of optical detectors that receive radiation from the illumination source that has been reflected from the image receiving surface. The radiation from the illumination source is usually visible light, but the radiation may be at or beyond either end of the visible light spectrum. If light is reflected by a white surface, the reflected light has the same spectrum as the illuminating light. In some systems, ink on the imaging surface may absorb a portion of the incident light, which causes the reflected light to have a different spectrum. In addition, some inks may emit radiation in a different wavelength than the illuminating radiation, such as when an ink fluoresces in response to a stimulating radiation. Each optical sensor generates an electrical signal that corresponds to the intensity of the reflected light received by the detector. The electrical signals from the optical detectors may be converted to digital signals by analog/digital converters and provided as digital image data to an image processor.

The environment in which the image data are generated is not pristine. Several sources of noise exist in this scenario and should be addressed in the registration process. For one, alignment of the printheads can deviate from an expected position significantly, especially when different types of imaging surfaces are used or when printheads are replaced. Additionally, not all inkjets in a printhead remain operational without maintenance. Thus, a need exists to continue to register the heads before maintenance can recover the missing jets. Also, some inkjets are intermittent, meaning the inkjet may fire sometimes and not at others. Inkjets also may not eject ink perpendicularly with respect to the face of the printhead. These off-angle ink drops land at locations other than where they are expected to land. Some printheads are oriented at an angle with respect to the width of the image receiving member. This angle is sometimes known as printhead roll in the art. The image receiving member also contributes noise. Specifically, structure in the image receiving surface and/or colored contaminants in the image receiving surface may be confused with ink drops in the image data and lightly colored inks and weakly performing inkjets provide ink drops that contrast less starkly with the image receiving member than darkly colored inks or ink drops formed with an appropriate ink drop mass. Thus, improvements in printed images and the analysis of the image data corresponding to the printer images are useful for identifying printhead orientation deviations and printhead characteristics that affect the ejection of ink from a printhead. Moreover, image data analysis that enables correction of printhead issues or compensation for printhead issues is beneficial.

SUMMARY

Analysis of test pattern image data in an inkjet printer is facilitated with the use of a template. The method of analysis includes identifying an origin position in the test pattern image data with reference to an origin identified by test pattern template data stored within a memory of the printer, identifying first inkjet positions for printheads that produce the test pattern in the test pattern image data with reference to first inkjet positions for the printheads identified by the test pattern template data stored within the memory of the printer, identifying last inkjet positions for printheads that produce the test pattern in the test pattern image data with reference to last inkjet positions for the printheads identified by the test pattern template data stored within the memory of the printer, identifying spatial differences between the first inkjet positions in the test pattern image data and the first inkjet positions identified by the test pattern template data stored within the memory of the printer, identifying spatial differences between the last inkjet positions in the test pattern image data and the last inkjet positions identified by the test pattern template data stored within the memory of the printer, and operating an actuator to move at least one printhead used to produce the test pattern in response to the identified spatial difference corresponding to the first inkjet or the last inkjet of the printhead not being within a predetermined range.

Another method also analyzes test pattern image data using a template. The printing apparatus includes identifying an origin position in the test pattern image data that corresponds to an origin identified by test pattern template data stored within a memory of the printer, identifying dash positions in the test pattern image data with reference to corresponding dash positions identified by the test pattern template data stored within the memory of the printer, identifying spatial differences between the dash positions in the test pattern image data and the dash positions identified by the test pattern template data stored within the memory of the printer, and operating an actuator to move a printhead used to produce the test pattern in response to the identified spatial differences not being within a predetermined range.

BRIEF DESCRIPTION OF THE DRAWINGS

The foregoing aspects and other features of a printer that analyzes test pattern image data with a template are explained in the following description, taken in connection with the accompanying drawings.

DETAILED DESCRIPTION

Figure 1:
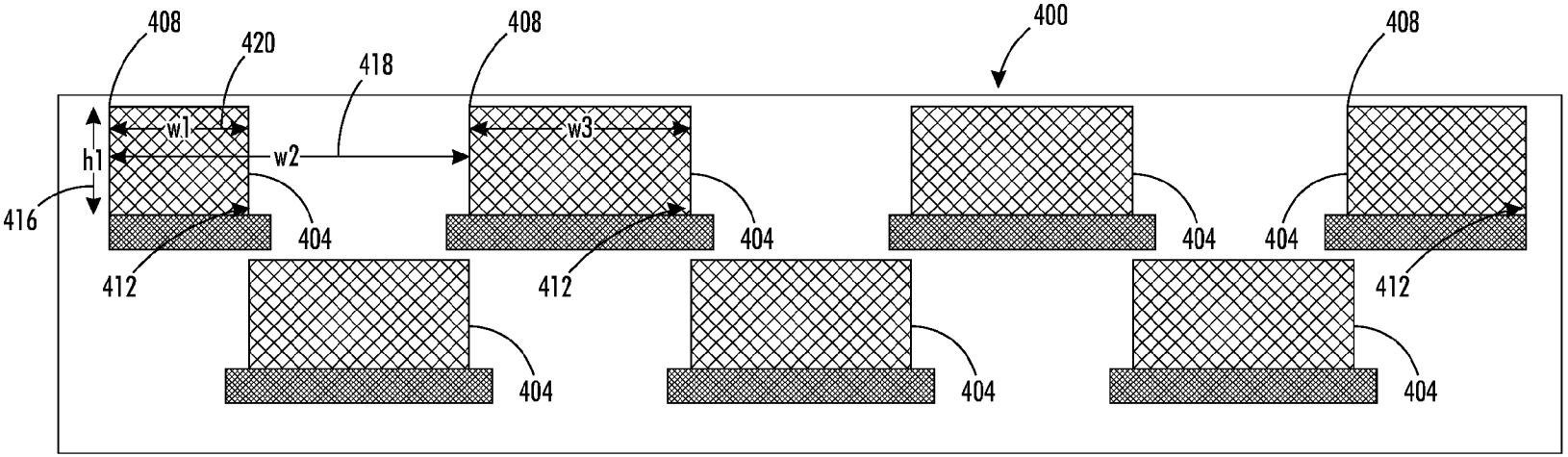
FIG. 1 is a depiction of a captured image of a portion of a test pattern on an image receiving member that is annotated with template data.

FIG. 1 is a depiction of a captured image of a portion of a test pattern on an image receiving member that is annotated with template data. The template data is useful for identifying printhead orientations and positions in the image data of the test pattern printed on an image receiving member by an inkjet printer. The template data are stored in the memory of a printer. These data identify the positions of the image area and the locations where ink accurately ejected by properly oriented and aligned printheads land onto the member. Thus, the template data noted in FIG. 1 represent the positions of ink drops and spatial distances between structures formed with ink drops, such as dashes or clusters, in test patterns.

In one embodiment, for example, the template data are described as:

HeadId=4
topLeftPixelX=1
topLeftPixelY=0
bottomRightPixelX=1049
bottomRightPixelY=1539
colorant=magenta
leftJetId=524
rightJetId=0

The HeadId identifies the printhead. The topLeftPixelX and topLeftPixelY identify the X and Y coordinates of the position for an accurately printed ink drop from the uppermost, leftmost inkjet of printhead 4. Likewise, the X and Y coordinates of the lowermost, rightmost positions are identified by bottomRightPixelX and bottomRightPixelY. The colorant value identifies the color of ink ejected by the printhead and the JetIl values identify the leftmost inkjet and the rightmost inkjet in the printhead. Using the four corner positions in the template data for a printhead, the height h1 416 and width w1 420 of the printheads can be established. The template also enables the distances between printheads to be identified with reference to right, left, top, and bottom edges of for each of the printheads. Additionally, the template enables the edges of an image area to be determined with reference to predetermined margins being added to the edges of the printheads required to print a particular size of image receiving member. For example, if a media web having a width is printed with the five leftmost printheads, the right edge of the image area is determined with reference to the right edge of either or both of the blocks identified by the template data. The identification of the image area boundaries is useful for cropping the image data for a printed test pattern.

In the image portion 400 depicted in FIG. 1 a plurality of ink drop blocks 404 are shown. Each block contains the ink drops ejected from each inkjet ejector of one printhead. Thus, intensity values 408 within each block represent the positions of the ink drops ejected by the left, uppermost inkjets of the seven printheads that printed the blocks 404 shown in FIG. 1. Likewise, the intensity values 412 represent the positions of the ink drops ejected by the right, lowermost inkjets of the seven printheads. Comparing the template data with the structure in the images enables the processor evaluating the image data to identify the distances between where an ink drop is and where it should be.

Figure 2:
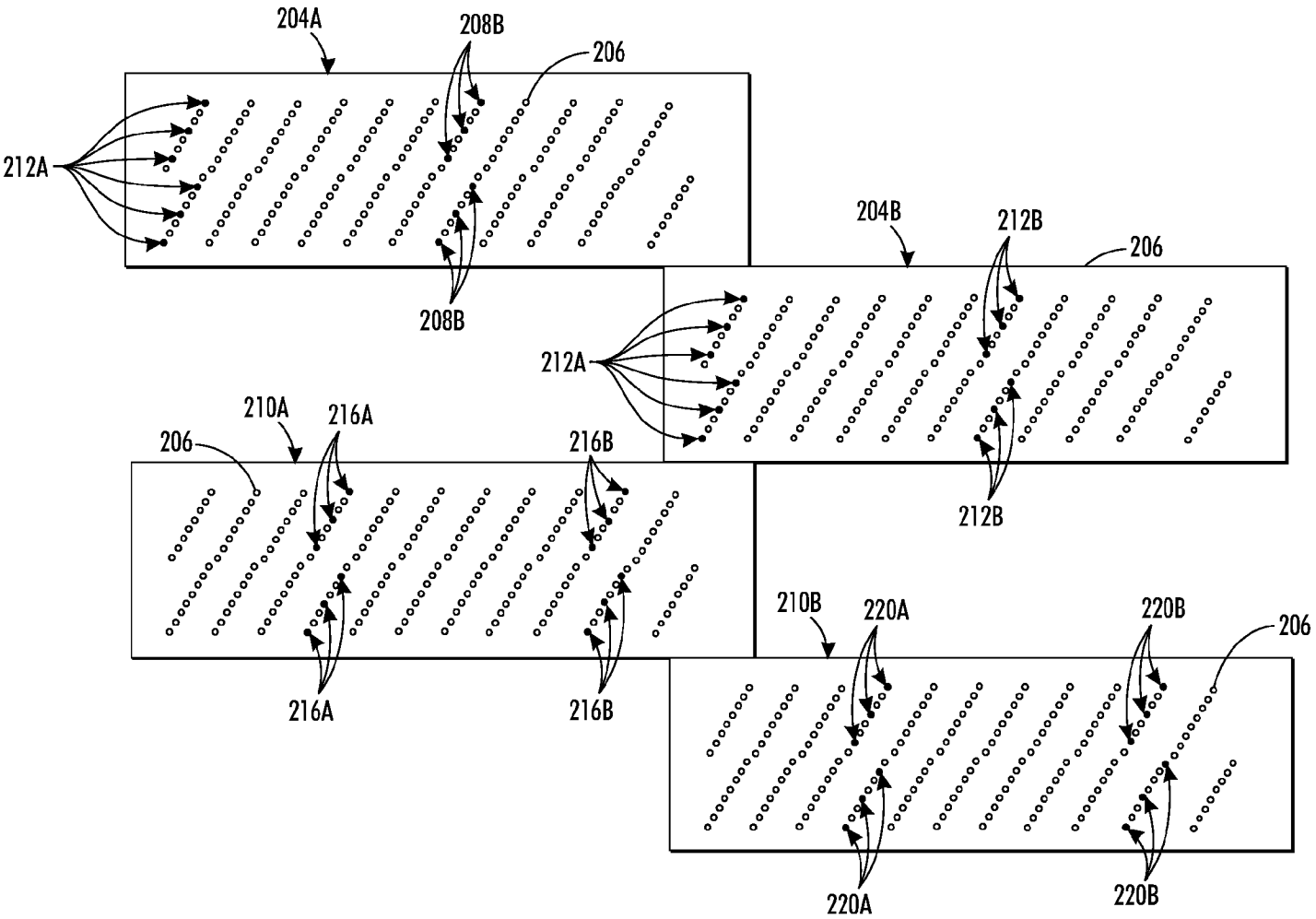
FIG. 2 is a front view of two rows of staggered printheads.

Four staggered printheads corresponding to the four leftmost printheads in the portion of the test pattern template of FIG. 1 are shown in FIG. 2. Two printheads 204A and 204B are arranged in a staggered configuration to allow inkjet ejectors 206 of each of the printheads 204A and 204B to eject ink droplets across the process at a first resolution onto an image receiving member. A second pair of printheads 210A and 210B are positioned in the process direction with respect to the printheads 204A and 204B, but these printheads are interlaced with printheads 204A and 204B. A group of the inkjet ejectors 206 in each printhead are selected to print the blocks, dashes, clusters, and arrangements for a test pattern. In printhead 204A, ejector groups 208A and 208B each include a total of six inkjet ejectors positioned on different rows of the printhead 204A. Each inkjet ejector is configured to output a predetermined number of ink drops to form a dash in a test pattern.

The inkjet ejectors in the group printing a cluster of dashes are selected to facilitate detection of printhead roll, among other reasons. In the embodiment depicted, the six nozzles chosen are from rows 1,4,7,10,13, and 16 of the printhead. If the printhead is rolled counterclockwise, the cross process direction spacing between these rows in the printed test pattern decreases. If the printhead is rolled clockwise, the cross process direction spacing between these rows in the printed test pattern increases. Printing from different printhead rows enables the image data analysis to monitor whether the printhead roll exceeds specifications to an extent that degrades image registration.

Likewise, printhead 210A also has a group of ejectors 206 selected for generating blocks, dashes, clusters, and arrangements in a test pattern. Each of the selected groups 208A, 208B, 216A and 216B print a separate test pattern arrangement for each of printheads 204A and 210A. Staggered printheads 204B and 210B have their own ejector groups 212A, 212B, 220A and 220B capable of printing test pattern arrangements on portions of an image receiving member that are different than the portions on which the test pattern arrangements produced by printheads 204A and 210A are printed. The printheads 204A, 204B, and 210A and 210B are shorter in length than the printheads that print a test pattern corresponding to the test pattern of FIG. 5 as a group of inkjet ejectors from each printhead in a column of printheads is selected to print the test pattern shown in FIG. 5. In a CMYK printer, the space between inkjet ejector groups in the first printhead in a column of printheads need to be separated by a distance that enables the printhead interlaced with the first printhead and each pair of printheads in the column with the first printhead to print a pair of test pattern arrangements corresponding to the arrangements of the template shown in FIG. 5. The staggered printhead arrangement of FIG. 2 may be repeated laterally across the width of an image receiving member moving past the printheads. Operating these printheads in a manner similar to the one described above enables the test pattern arrangements to be printed across the width of the image receiving member. Additionally, while FIG. 2 depicts two staggered printhead arrays, alternate configurations may use three or more arrays with varying degrees of offset to provide different print resolutions.

Figure 3:
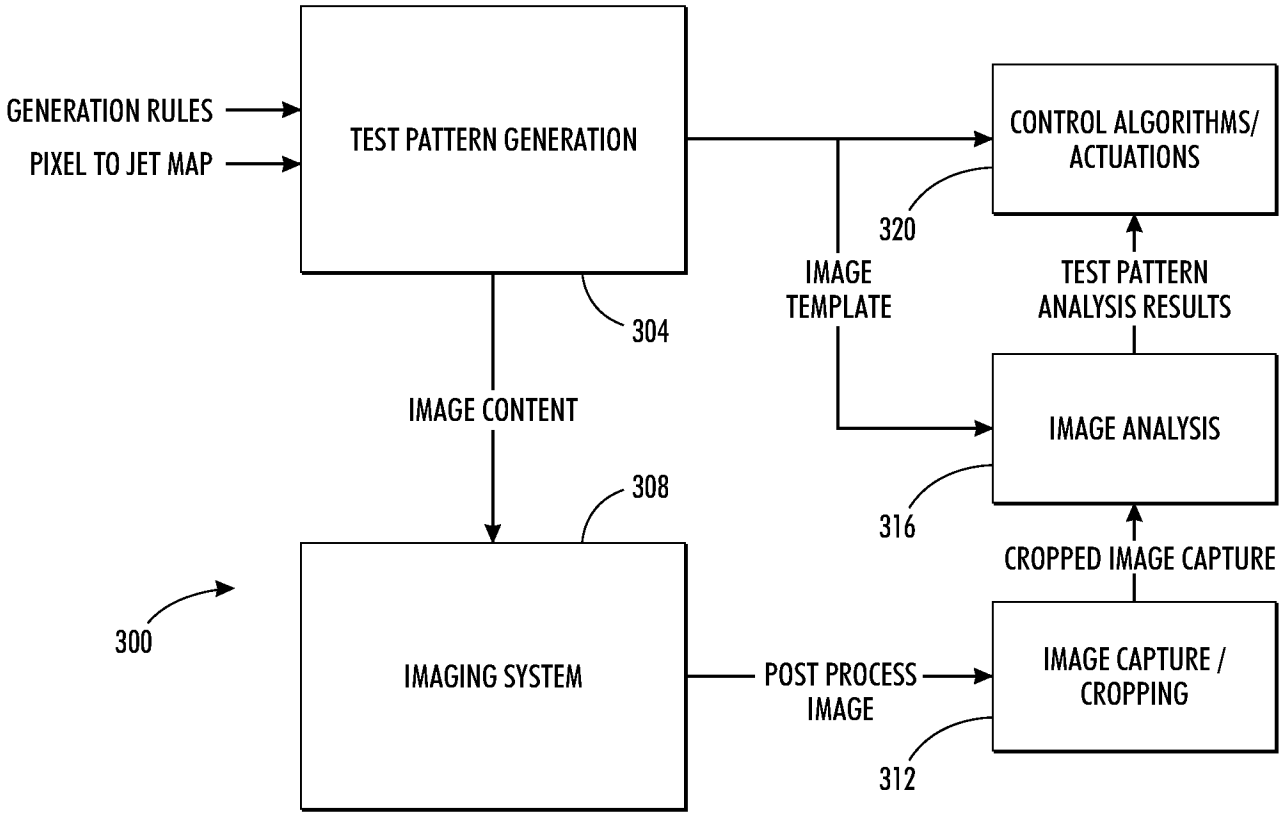
FIG. 3 is a block diagram of a system performing analysis of image data of a test pattern printed on an image receiving member using a test pattern template.

A system for analyzing test pattern image data is shown in FIG. 3. The system 300 includes a test pattern generator 304, an image data generator 308, an image data cropper 312, an image analyzer 316, and a printhead correction circuit 320. The test pattern generator 304 is typically implemented in the printer controller. The controller selects from memory data defining a test pattern that best enable detection of printhead misalignment and image registration issues. These data are rendered by a marking engine in the printer to generate the memory maps provided to the printhead controllers in the printer. The printhead controllers generate firing signals corresponding to the test pattern data and the printhead parameters stored in the memory of the printhead controllers. For each of these test patterns, a template data corresponding to the selected test pattern are generated to represent the ink drop intensities and spatial relationships expected for accurately printed test patterns. Thus, the template data are able to correspond to the operational conditions, such as process direction speed and timing parameters to generate the template data accurately.

Once a test pattern is printed on an image receiving member, the printed test pattern is imaged by imaging system 308 using an optical sensor. In one embodiment, the optical sensor includes an array of photodetectors mounted to a bar or other longitudinal structure that extends across the width of an imaging area on the image receiving member. The photodetectors in some embodiments are monochromatic and in other embodiments are chromatic. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal may be used to identify the positions of ink drops on an image receiving member, such as a paper sheet, media web, or print drum. The reader should note, however, that lighter colored inks, such as yellow, cause optical detectors to generate lower contrast signals with respect to the signals received from un-inked portions than darker colored inks, such as black. Thus, the contrast may be used to differentiate between dashes of different colors. The magnitudes of the electrical signals generated by the optical detectors may be converted to digital values by an appropriate analog/digital converter. These digital values are denoted as image data in this document and these data are analyzed to identify positional information about the dashes on the image receiving member as described below.

The intensity values generated by the imaging system 308 are sent to the image cropper 312. Additionally, the image cropper 312 also receives the template data corresponding to the printed test pattern. The image cropper uses the margins for the image area and the edges defined by the leftmost and rightmost inkjets of the printheads to eliminate image data values that correspond to positions outside of the image area. Consequently, areas of the image data that could be erroneously analyzed as containing ink drops ejected from inkjets are removed.

The cropped image data values are sent to the image analyzer 316. The image analyzer 316 includes a controller or other processor that is communicatively coupled to a memory in which instructions and data are stored that configure the controller to perform the processes shown in FIG. 4 and FIG. 6 or similar processes. The image analyzer is implemented, in some embodiments, with the controller for the printer executing stored programmed instructions. In other embodiments, the image analyzer 316 is implemented with a digital signal processor executing programmed instructions stored in the memory of the processor. The image analyzer compares the cropped image data to the template data to identify one or more common points to synchronize the test pattern template with the cropped image data and the spatial data and intensities identified by the template are used to evaluate the image data and generate correctional data for the printheads. These correctional data are used by the printer controller to operate actuators that move the printheads in the cross-process direction or to rotate the printheads to correct cross-process misalignment and roll error. In addition, the template data are used for intensity correction and normalization. For example, the actual average intensity value for the ink drops ejected by each printhead can be identified and compared to the template data expected average value. The differences can be compared to thresholds and, if a difference is outside the expected average value range, adjustments to firing signal parameters are generated to adjust the firing signals for a printhead to bring the actual ink drop masses closer to the expected average value for a printhead. Normalization refers to adjustments further made to the firing signal parameters to bring the ink drop masses of printheads ejecting the same color within a range about the expected average intensity of the template data across those printheads.

Figure 4:
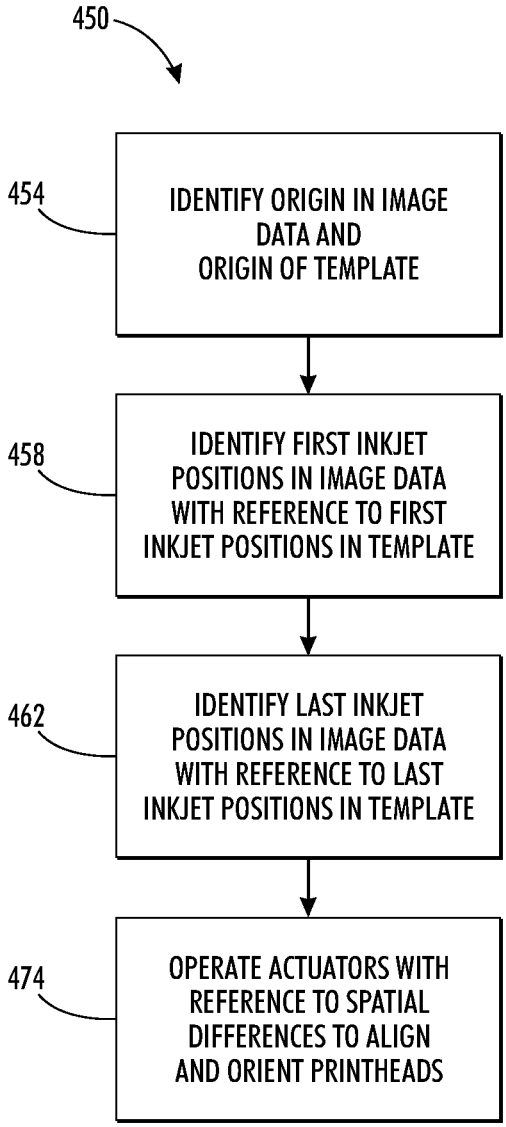
FIG. 4 is a flow diagram of a method for identifying printhead orientations and positions suitable for use with the test pattern template of FIG. 1.

A method for image analysis using a test pattern template is shown in FIG. 4. The process 450 begins with the identification of an origin position in the test pattern image data that corresponds to an origin identified by the template data for the test pattern (block 454). This identification requires the image analyzer to detect the dash structure in the image data and compare the positions of the detected positions to the template data. Then the image analyzer can position and orient the template data with the cropped image area. Once the template data is properly oriented and positioned with respect to the image data, the spatial differences between the first inkjet positions for the printheads corresponding to the test pattern image data and the first inkjet positions for the printheads defined by the template data are identified (block 458). Also, the differences between the last inkjet positions for the printheads corresponding to the test pattern image data and the last inkjet positions for the printheads defined by the template data are identified (block 462). These spatial differences are used by the printer controller to operate one or more actuators to move printheads used to produce the test pattern in response to the identified spatial difference corresponding to the first inkjet or last inkjet of the printhead not being within a predetermined range (block 474). The process may be repeated to confirm the printheads are properly aligned and oriented.

The process of FIG. 4 is enabled to identify printing errors because the template data identify predetermined distances between the first inkjets of printheads in a row aligned in the cross-process direction. The template data also identify predetermined distances between the last inkjets of printheads in a row aligned in the cross-process direction. Likewise, the template data identify a predetermined height between the first inkjet of a printhead and the last inkjet of a printhead in a process direction. Additionally, the edges identified in the template data enable the image cropper to identify the image area with reference to the margin distances in a cross-process direction and to exclude from image data analysis a portion of the test pattern image data that corresponds to test pattern image data that is outside the image area.

The ability to differentiate dashes of different ink colors is subject to the phenomenon of missing or weak inkjet ejectors. Weak inkjet ejectors are ejectors that do not respond to a firing signal by ejecting an amount of ink that corresponds to the amplitude or frequency of the firing signal delivered to the inkjet ejector. A weak inkjet ejector, instead, delivers a lesser amount of ink. Consequently, the lesser amount of ink ejected by a weak jet covers less of the image receiving member so the contrast of the signal generated by the optical detector with respect to the ink receiving member is lower. Therefore, ink drops in a dash ejected by a weak inkjet ejector may result in an electrical signal that has a magnitude close to the magnitude of an appropriately sized ink drop ejected by an inkjet ejector ejecting a lighter colored ink. Missing inkjet ejectors are inkjet ejectors that eject little or no ink in response to the delivery of a firing signal. As used in this document, "missing inkjets" means both weak and missing inkjets.

Figure 5:
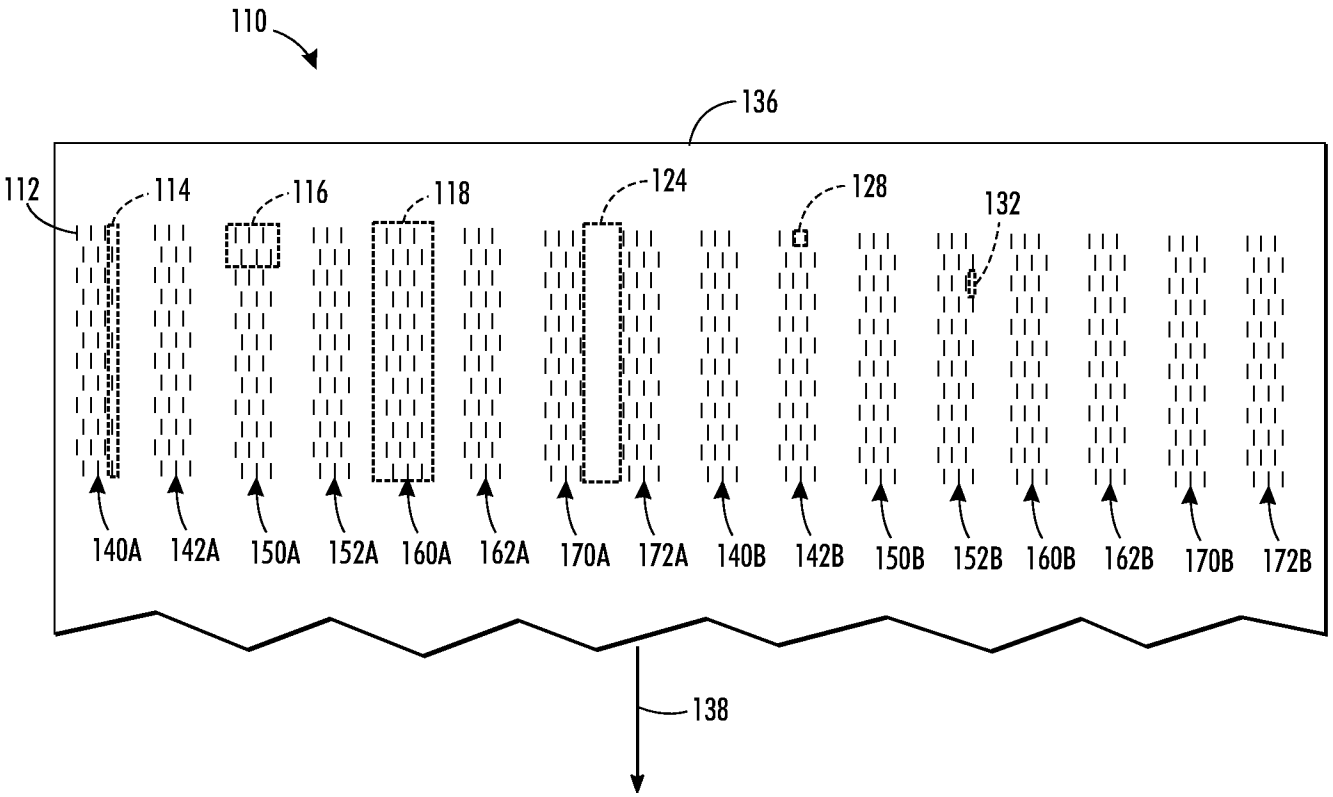
FIG. 5 is a depiction of a second test pattern template that is useful for identifying printhead orientations and positions in image data of a corresponding second test pattern printed on an image receiving member by an inkjet printer.

A test pattern that is useful for identifying the inkjet ejectors that fail to eject ink drops having a proper mass is shown in FIG. 5. The test pattern 110 includes a plurality of arrangements 118 of dashes 112 corresponding to a test pattern printed on an image receiving member 136, which is depicted in the figure as a sheet of paper, although the image receiving member may be a print web, offset imaging member, or the like. The image receiving member 136 moves in the process direction past a plurality of printheads that eject ink onto the image receiving member to form the test pattern 110. The test pattern arrangements 118 are separated from one another by a predetermined horizontal distance 124. Each test pattern arrangement 118 includes a plurality of clusters 116 of dashes 112. Each cluster 116 has a predetermined length and width and each dash has a predetermined start position and a predetermined end position. In each column of the test pattern, such as column 114, within an arrangement 118 of dashes 112, a predetermined distance 132 separates each dash 112 in one cluster 116 from a next dash in another cluster 116 of the arrangement 118 in the process direction. In the embodiment shown in FIG. 5, each cluster 116 has six dashes. Each dash 112 has a predetermined length. Each cluster 116 has two staggered rows of three dashes 112 each, with a predetermined distance 128 separating the dashes 112 in a cluster 116 in the cross-process direction.

The test pattern arrangements 118 depicted in FIG. 5 are further grouped into pairs. In some embodiment, the multiple test pattern arrangements 118 have different colors, such as cyan, magenta, yellow, and black (CMYK). According to the test pattern embodiment of FIG. 5, adjacent test pattern arrangements 140A and 142A are comprised of cyan dashes. Likewise, adjacent test pattern arrangements 140B and 142B are comprised of cyan dashes. Test pattern arrangements 140A and 140B correspond to one cyan ink ejecting printhead, while the test pattern arrangements 142A and 142B correspond to a second cyan ink ejecting printhead that is interlaced with the first cyan ink ejecting printhead. In FIG. 5, test pattern groups 150A and 150B correspond to a first magenta printhead while test pattern groups 152A and 152B correspond to a second magenta printhead that is interlaced with the first magenta printhead. The same sequence applies to the test pattern groups 160A and 160B and the test pattern groups 162A and 162B for the color yellow. The test patterns 170A and 170B and 172A and 172B correspond to printheads ejecting black ink. The series of test pattern arrangements depicted in FIG. 5 may be repeated for multiple printheads.

The test pattern data used by a printer controller to produce the test pattern of FIG. 5 on an image receiving member is also used to generate the template data. The pixel-to-inkjet map and generation rules are used by the generator 304 to generate the X and Y coordinates for structure in the test pattern, to identify the start and ending positions for the dashes and clusters, to identify the image area, and other related data as discussed above. These template data are then used to analyze the captured image data of the printed test pattern on the image receiving member.

Figure 6:
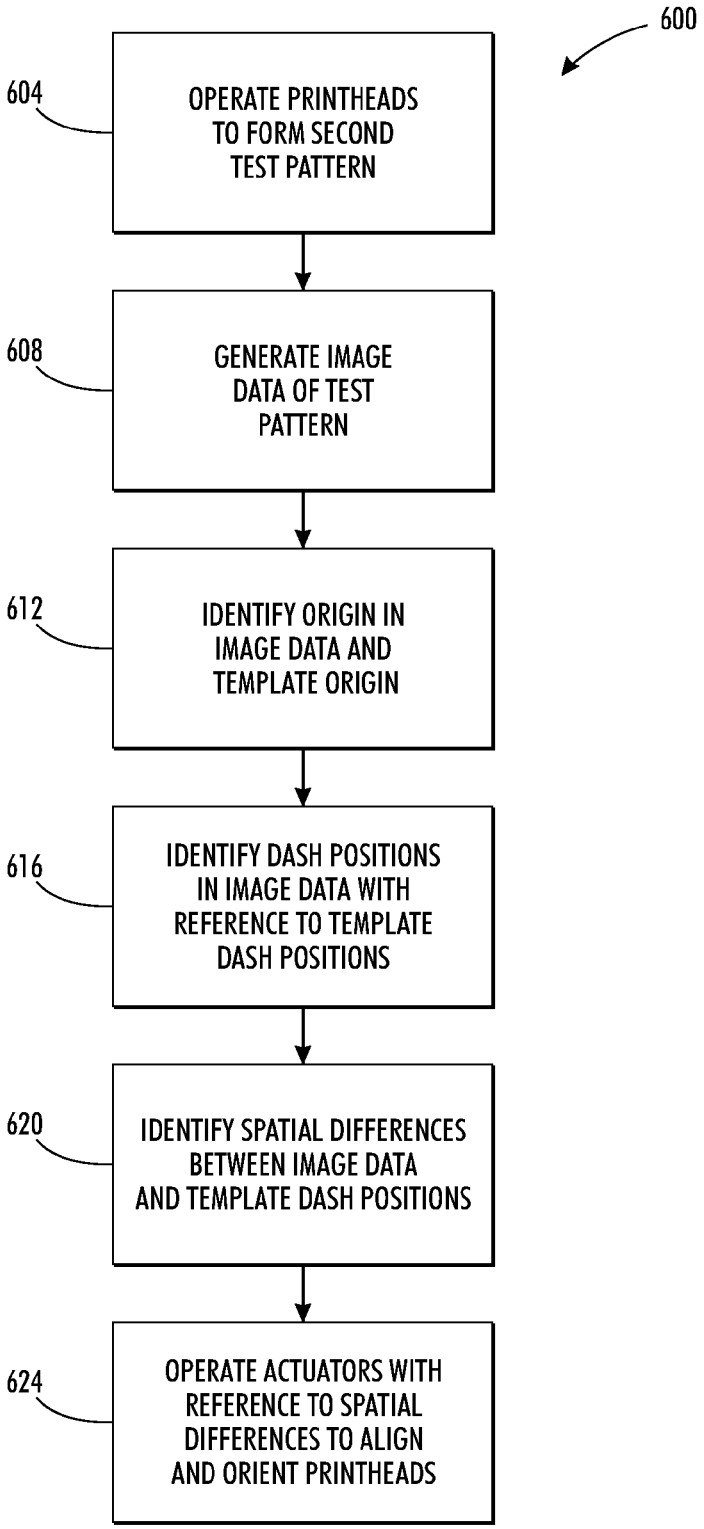
FIG. 6 is a flow diagram of a process for analyzing image data to identify inoperable inkjet ejectors in a printhead as well as the positions and orientations of the printheads.

A block diagram of a process 600 for analyzing image data corresponding to the test pattern of FIG. 5 printed on an image receiving member is depicted in FIG. 6. The process 600 begins by operating a plurality of printheads to eject ink onto the image receiving member to generate the test pattern on an image receiving member (block 604). The test pattern, in some embodiments, corresponds to the test pattern template shown in FIG. 5. Image data of the test pattern on the image receiving member is generated (block 608) and an origin position in the image data of the test pattern and an origin in the template data is identified (block 612). The dash positions in the image data for the test pattern are then identified with reference to corresponding dash positions identified in the template data (block 616). The spatial differences between the dash positions in the image data of the test pattern and the dash positions identified by the template data are identified (block 620) and the spatial differences are used by the printer controller to operate one or more actuators to move one or more printheads used to produce the test pattern in response to the identified spatial differences not being within a predetermined range (block 624). Additionally, firing signal parameters are adjusted to bring the ink drop masses within a printhead to an expected value and to bring the range of ink drop masses ejected by the printheads ejecting the same color of ink within a predetermined range.

Process 600 enables inoperable inkjets to be identified with reference to the spatial differences between a dash position in the image data of the test pattern and a dash position identified by the template data exceeding a predetermined threshold. Similarly, the identification of the spatial differences also enable a spatial difference between a start position of a dash identified by the template data and a start position of a corresponding dash in the image data of the test pattern to be identified. Likewise, the spatial difference between an end position of a dash in the template data from an end position of a corresponding dash in the image data of the test pattern can be identified. The process of FIG. 6, in some embodiments, is performed immediately following the performance of the process in FIG. 4 and, in other embodiments, is performed in a standalone manner.

Figure 7:
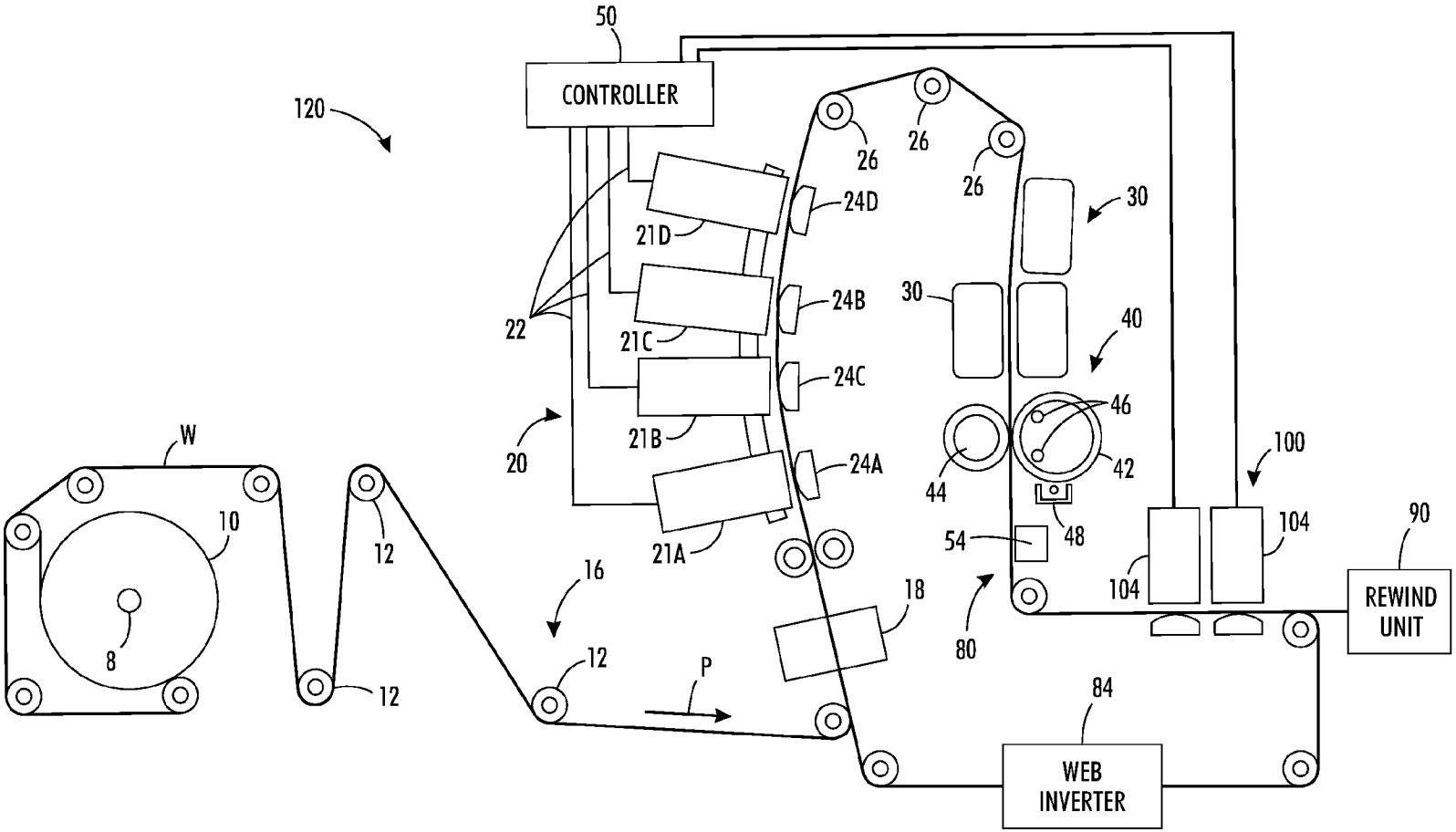
FIG. 7 is a schematic view of a prior art inkjet imaging system that ejects ink onto a continuous web of media as the media moves past the printheads in the system.

Referring to FIG. 7, a prior art inkjet imaging system 120 is shown. For the purposes of this disclosure, the imaging apparatus is in the form of an inkjet printer that employs one or more inkjet printheads and an associated solid ink supply. However, the test pattern and methods described herein are applicable to any of a variety of other imaging apparatus that use inkjets to eject one or more colorants to a medium or media. The imaging apparatus includes a print engine to process the image data before generating the control signals for the inkjet ejectors. The colorant may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

FIG. 7 is a simplified schematic view of a direct-to-sheet, continuous-media, phase-change inkjet imaging system 120, that may be modified to generate the test patterns, analyze image data of the test patterns with reference to test pattern templates, and adjust printheads using the methods discussed above. A media supply and handling system is configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 100, and rewind unit 90. For duplex operations, the web inverter 84 is used to flip the web over to present a second side of the media to the printing station 20, printed web conditioner 80, and coating station 100 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 100 before being flipped by the inverter 84 and laterally displaced by a distance that enables the web to travel over the other half of the rollers opposite the printing station 20, printed web conditioner 80, and coating station 100 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, rotating one or more rollers. The media conditioner includes rollers 12 and a pre-heater 18. The media is transported through a printing station 20 that includes a series of printhead modules 21A, 21B, 21C, and 21D, each printhead module effectively extending across the width of the media and being able to place ink directly (i.e., without use of an intermediate or offset member) onto the moving media. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to compute the position of the web as moves past the printheads. The controller 50 uses these data to generate timing signals for actuating the inkjet ejectors in the printheads to enable the four colors to be ejected with a reliable degree of accuracy for registration of the differently color patterns to form four primary-color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various possible embodiments, a printhead module for each primary color may include one or more printheads; multiple printheads in a module may be formed into a single row or multiple row array; printheads of a multiple row array may be staggered; a printhead may print more than one color; or the printheads or portions thereof can be mounted movably in a direction transverse to the process direction P, such as for spot-color applications and the like.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each printhead module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page.

The coating station 100 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 100 may apply the clear ink with either a roller or a printhead 104 ejecting the clear ink in a pattern. Clear ink for the purposes of this disclosure is functionally defined as a substantially clear overcoat ink that has minimal impact on the final printed color, regardless of whether or not the ink is devoid of all colorant.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 120 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the difference minimization function, described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The imaging system 120 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for analyzing image data of a test pattern generated by a printer comprising:

identifying an origin position in the test pattern image data with reference to an origin identified by test pattern template data stored within a memory of the printer;

identifying first inkjet positions for printheads that produce the test pattern in the test pattern image data with reference to first inkjet positions for the printheads identified by the test pattern template data stored within the memory of the printer;

identifying last inkjet positions for printheads that produce the test pattern in the test pattern image data with reference to last inkjet positions for the printheads identified by the test pattern template data stored within the memory of the printer;

identifying spatial differences between the first inkjet positions in the test pattern image data and the first inkjet positions identified by the test pattern template data stored within the memory of the printer;

identifying spatial differences between the last inkjet positions in the test pattern image data and the last inkjet positions identified by the test pattern template data stored within the memory of the printer; and operating an actuator to move at least one printhead used to produce the test pattern in response to the identified spatial difference corresponding to the first inkjet or the last inkjet of the printhead not being within a predetermined range.

2. The method of claim 1, wherein the test pattern template data stored within the memory of the printer identifies a predetermined distance between a first inkjet of a first printhead and a first inkjet of a second printhead in a cross-process direction.

3. The method of claim 1, wherein the test pattern template data stored within the memory of the printer identifies a predetermined distance between a last inkjet of a first printhead and a last inkjet of a second printhead in a cross-process direction.

4. The method of claim 1, wherein the test pattern template data stored within the memory of the printer identifies a predetermined height between the first inkjet of a printhead and the last inkjet of a printhead in a process direction.

5. The method of claim 1, wherein the test pattern template stored within the memory of the printer identifies a predetermined distance in a cross-process direction between a first inkjet of a first printhead and an edge identified by the test pattern template data stored within the memory of the printer.

6. The method of claim 1, wherein the test pattern template stored within the memory of the printer identifies a predetermined distance in a cross-process direction between a last inkjet of a last printhead and an edge identified by the test pattern template data stored within the memory of the printer.

7. The method of claim 5 further comprising:

excluding from image data analysis a portion of the test pattern image data that corresponds to test pattern image data beyond the edge identified by the test pattern template data stored within the memory of the printer.

8. The method of claim 6 further comprising:

excluding from image data analysis a portion of the test pattern image data that corresponds to test pattern image data beyond the edge identified by the test pattern template data stored within the memory of the printer.

9. The method of claim 1 further comprising:

generating a second test pattern on an image receiving member by operating a plurality of printheads to eject ink onto the image receiving member;

generating image data of the second test pattern on the image receiving member;

identifying an origin position in the image data of the second test pattern with reference to an origin identified by second test pattern template data stored within the memory of the printer;

identifying dash positions in the image data for the second test pattern with reference to corresponding dash positions identified by the second test pattern template data stored within the memory of the printer;

identifying spatial differences between the dash positions in the image data of the second test pattern and the dash positions identified by the second test pattern template data stored within the memory of the printer; and operating the actuator to move a printhead used to produce the second test pattern in response to the identified spatial differences not being within a predetermined range.

10. The method of claim 9 further comprising:

identifying inoperable inkjets in response to the spatial difference between a dash position in the image data of the second test pattern and a dash position identified by the second test pattern template data stored within the memory of the printer exceeding a predetermined threshold.

11. The method of claim 9, the identification of spatial differences further comprising:

identifying a spatial difference between a start position of a dash identified by the second test pattern template data stored within the memory of the printer from a start position of a corresponding dash in the image data of the second test pattern.

12. The method of claim 9, the identification of spatial differences further comprising:

identifying a spatial difference between an end position of a dash identified by the second test pattern template from an end position of a corresponding dash in the image data of the second test pattern.

13. A method for analyzing image data of a test pattern generated by a printer comprising:

identifying an origin position in the test pattern image data that corresponds to an origin identified by test pattern template data stored within a memory of the printer;

identifying dash positions in the test pattern image data with reference to corresponding dash positions identified by the test pattern template data stored within the memory of the printer;

identifying spatial differences between the dash positions in the test pattern image data and the dash positions identified by the test pattern template data stored within the memory of the printer; and operating an actuator to move a printhead used to produce the test pattern in response to the identified spatial differences not being within a predetermined range.

14. The method of claim 13 further comprising:

identifying inoperable inkjets in response to the spatial difference between a dash position in the test pattern image data and a dash position identified by the test pattern template data stored within the memory of the printer exceeding a predetermined threshold.

15. The method of claim 13, the identification of spatial differences further comprising:

identifying a spatial difference between a start position of a dash identified by the test pattern template data from a start position of a corresponding dash in the test pattern image data.

16. The method of claim 13, the identification of spatial differences further comprising:

identifying a spatial difference between an end position of a dash identified by the test pattern template data stored within the memory of the printer from an end position of a corresponding dash in the test pattern image data.

* * * * *